US006886719B1

(12) United States Patent
Shen et al.

(10) Patent No.: US 6,886,719 B1
(45) Date of Patent: May 3, 2005

(54) MAKEUP POWDER COMPACT

(75) Inventors: Chien-Hung Shen, Tainan (TW); Pei-Lain Lin, Tainan Hsieh (TW)

(73) Assignee: Mei-Shual Cosmetics Co., Ltd., Tainan (TW)

( * ) Notice: Subject to any disclaimer, the term of this patent is extended or adjusted under 35 U.S.C. 154(b) by 0 days.

(21) Appl. No.: 10/837,656

(22) Filed: May 4, 2004

(51) Int. Cl.[7] ..... B67D 3/00
(52) U.S. Cl. ..... 222/480; 222/548; 132/298
(58) Field of Search ..... 222/548, 480; 132/298; 220/253

(56) References Cited

U.S. PATENT DOCUMENTS 3,058,630 A * 10/1962 Walter ..... 222/548
3,229,867 A * 1/1966 Torii et al. ..... 222/480
5,507,419 A * 4/1996 Martin et al. ..... 222/480

* cited by examiner

*Primary Examiner*—Philippe Derakshani
(74) *Attorney, Agent, or Firm*—Rosenberg, Klein & Lee

(57) ABSTRACT

A makeup powder compact includes a case having a hour-glass-shaped receiving space for storing makeup powder therein and an inner cap is engaged with the open top of the case. A central hole is defined through the inner cap and a plurality of apertures are defined through the inner cap and located beside the central hole. A rotatable cap is rotatably mounted to the inner cap and has a through hole which is aligned with the apertures of the inner cap by rotating the rotatable cap so as to pour the powder from aligned through hole and the apertures. A cover is mounted to the stepped protrusion of the case.

5 Claims, 4 Drawing Sheets

MAKEUP POWDER COMPACT

FIELD OF THE INVENTION

The present invention relates to a makeup powder compact with an hourglass-shaped space for receiving the powder and a rotatable cap for aligning holes with an inner cap to allow the powder to come out.

BACKGROUND OF THE INVENTION

A conventional makeup powder compact generally includes a base with a receiving recess in which the makeup powder is received and a cover is pivotably connected to the base. Most of the conventional makeup powder compacts are made to a round or rectangular box like assembly. This traditional shape of the powder compacts is utilized for years and cannot meet some young customers' requirements, the youth want to have their makeup powder compacts to be attractive, different or even funny.

The present invention intends to provide a makeup powder compact that has a case with an hourglass-shaped receiving space therein and a rotatable cap to have the makeup powder from the case.

SUMMARY OF THE INVENTION

The present invention relates to a makeup powder compact which comprises a case having a receiving space for storage of makeup powder and an open top with which an inner cap is engaged. A central hole is defined through the inner cap and a plurality of apertures are defined through the inner cap and located beside the central hole. A rotatable cap is rotatably mounted to the inner cap and has a through hole which is aligned with the apertures in the inner cap by rotating the rotatable cap relative to the inner cap. A cover is mounted to the stepped protrusion on the top of the case.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
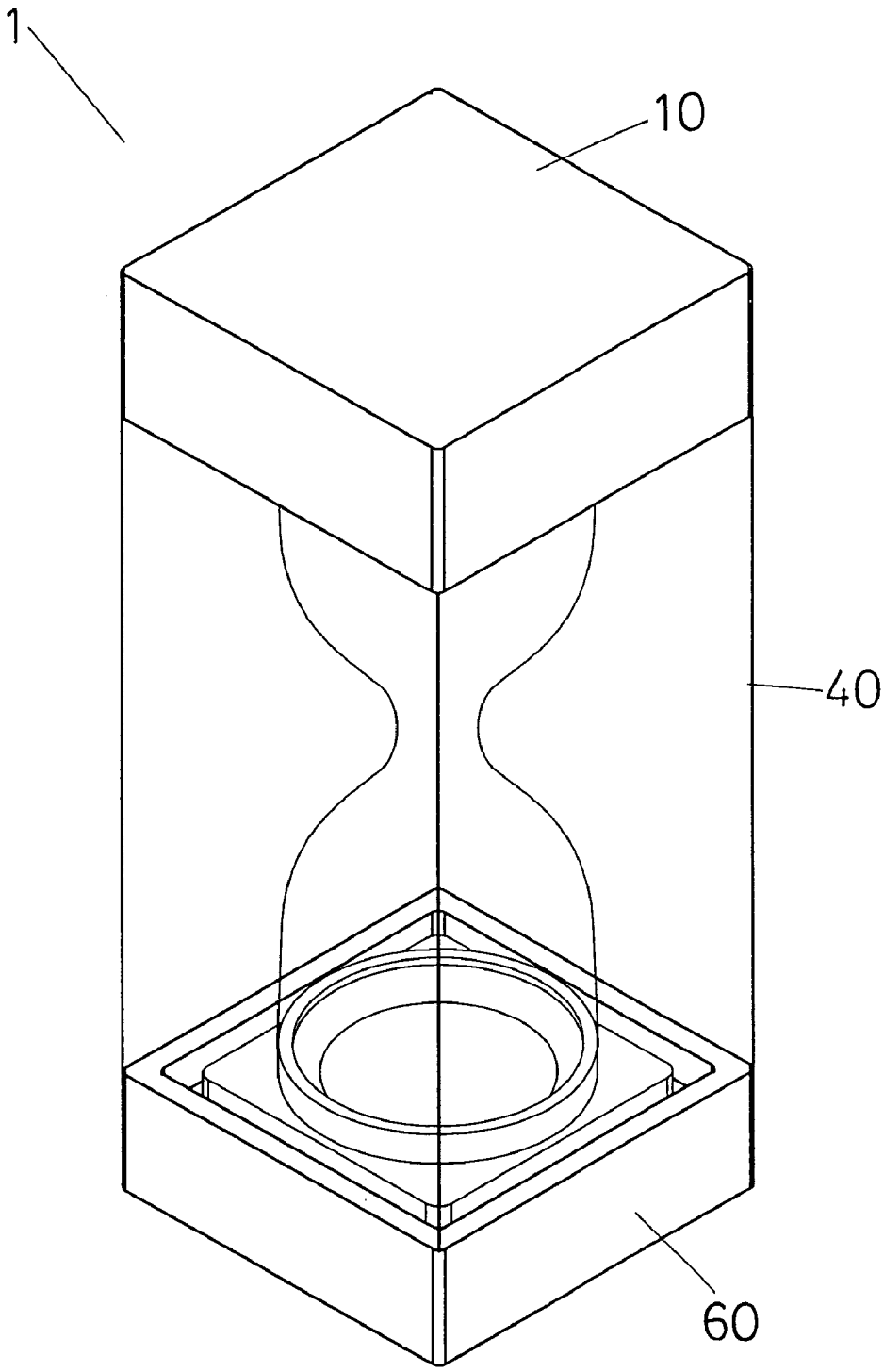
FIG. 1 is a perspective view to show the makeup powder compact of the present invention.
Figure 2:
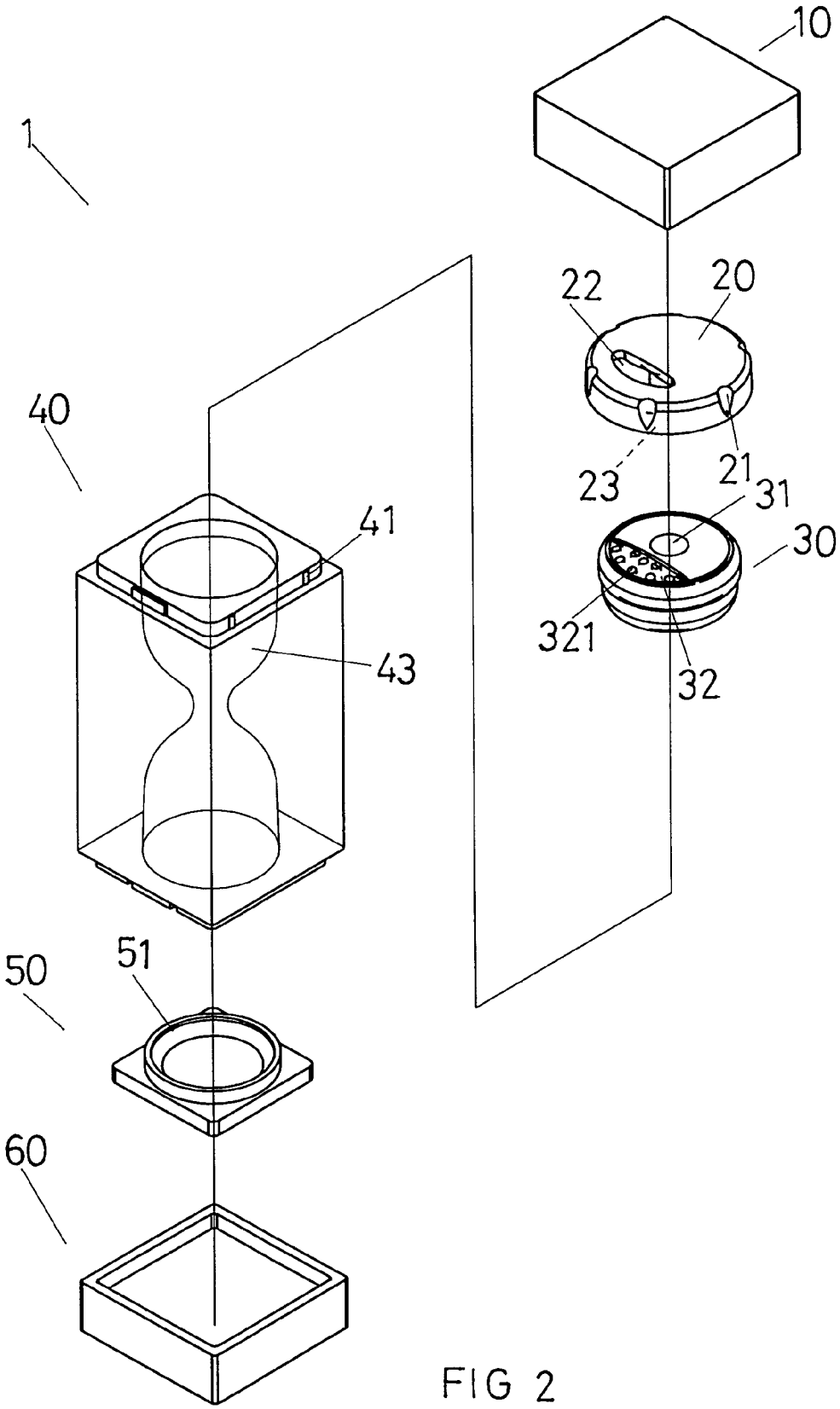
FIG. 2 is an exploded view to show the makeup powder compact of the present invention.
Figure 3:
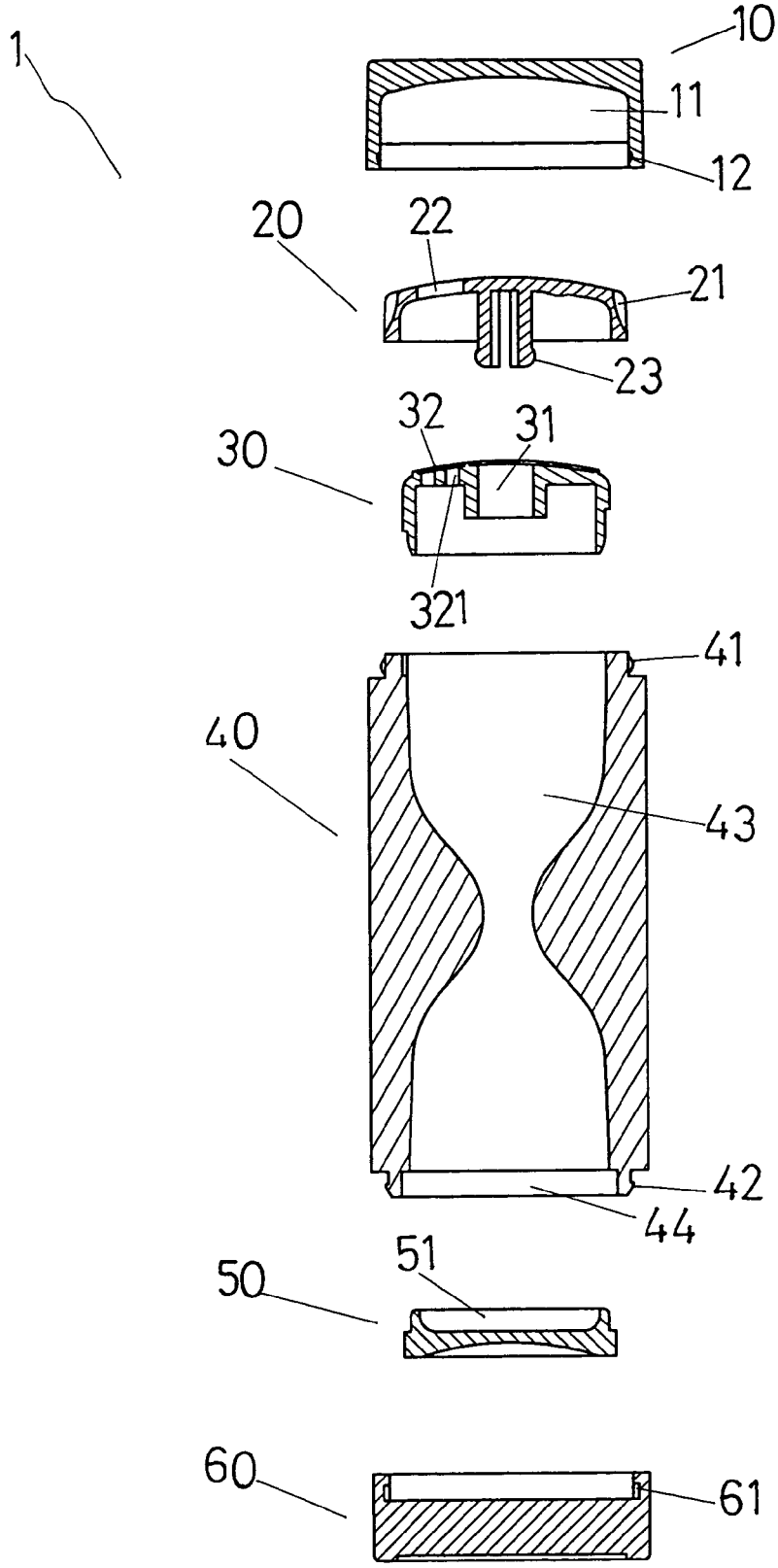
FIG. 3 is a cross sectional view to show the parts of the makeup powder compact of the present invention.

Referring to FIGS. 1 to 3, the makeup powder compact 1 of the present invention comprises a case 40 having an hourglass-shaped receiving space 43 defined therein so as to receive makeup powder therein. A bottom cap 50 includes an insertion 51 which is engaged with an inner periphery of a neck 44 extending from the bottom of the case 40 so that the makeup powder does not fall from the bottom of the case 40. The neck 44 has bosses 42 on an outer periphery thereof and a lower cover 60 is mounted to the neck 44 and the bosses 42 are engaged with engaging notches 61 defined in an inner periphery of the lower cover 60. Another stepped protrusion extends from a top of the case 40 and located around the open top.

An inner cap 30 is engaged with the open top and has a central hole 31. A tube extends from an underside of the inner cap 30 and communicates with the central hole 31. A recess 32 is defined in a top surface of the inner cap 30 and located beside the central hole 31. A plurality of apertures 321 are defined through the inner cap 30 and located in the recess 32.

Figure 4:
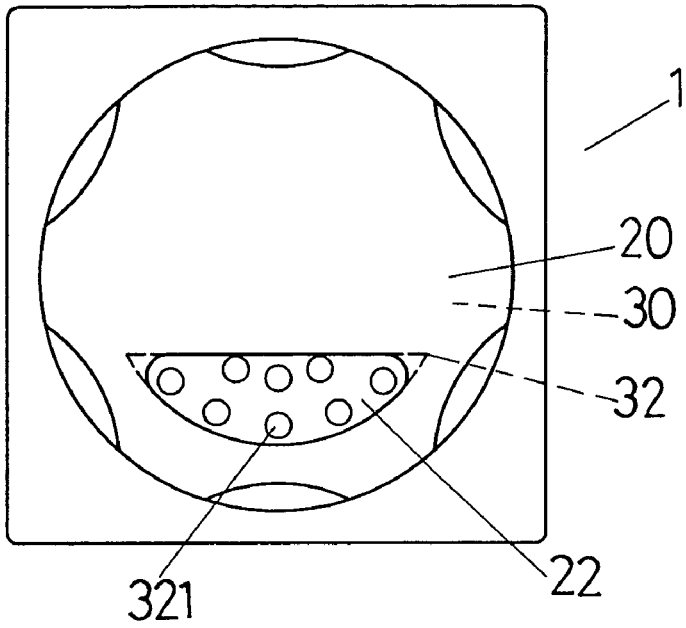
FIG. 4 shows a top view of the makeup powder compact wherein the through hole in the rotatable cap is in alignment with the apertures in the inner cap.
Figure 5:
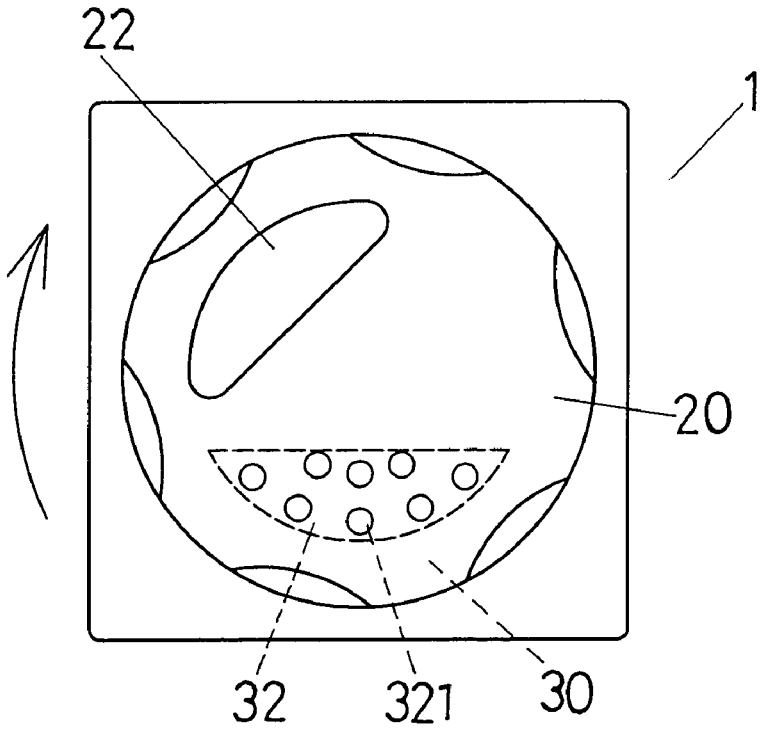
FIG. 5 shows a top view of the makeup powder compact wherein the through hole in the rotatable cap is not in alignment with the apertures in the inner cap.

A rotatable cap 20 is rotatably mounted to the inner cap 30 and has a shaft 23 extending from an underside thereof. The shaft 23 includes two splits and each split includes a hook edge so that the shaft 23 is rotatably engaged with the tube of the inner cap 30 and the hook edges of the two splits of the shaft 23 engage the lower end of the tube of the inner cap 30. A through hole 22 is defined through the rotatable cap 20 which is aligned with the apertures 321 in the inner cap 30 by rotating the rotatable cap 20 relative to the inner cap 30 as shown in FIG. 4 so that the makeup power can be poured out therefrom. A plurality of operation concavities 21 are defined in an outer periphery of the rotatable cap 20 so that the user may easily rotate the rotatable cap 20 by putting fingers in the operation concavities 21.

A cover 10 is mounted to the stepped protrusion of the case 40 and hides the inner cap 30 and the rotatable cap 20 therebeneath. The stepped protrusion includes bosses 41 extending from a periphery thereof and the cover 10 includes engaging notches 12 defined in an inner periphery thereof, the bosses 41 being engaged with the engaging notches 12.

The case 40 is made of transparent material so that the makeup powder in the hourglass-shaped receiving space 43 performs as sands and flows to a lower end of the two large spaces of the receiving space 43.

While we have shown and described the embodiment in accordance with the present invention, it should be clear to those skilled in the art that further embodiments may be made without departing from the scope of the present invention.

What is claimed is:

1. A makeup powder compact comprising:

a case having a receiving space and an open top and a closed bottom, a stepped protrusion extending from a top of the case and located around the open top;

an inner cap engaged with the open top and a central hole defined through the inner cap, a plurality of apertures defined through the inner cap and located beside the central hole;

a rotatable cap rotatably mounted to the inner cap and having a through hole defined therethrough which is aligned with the apertures in the inner cap by rotating the rotatable cap relative to the inner cap, and a cover mounted to the stepped protrusion of the case.

2. The makeup powder compact as claimed in claim 1, wherein a tube extends from an underside of the inner cap and communicates with the central hole, the rotatable cap having a shaft extending from an underside thereof and the shaft is rotatably engaged with the tube of the inner cap.

3. The makeup powder compact as claimed in claim 1, wherein a recess is defined in a top surface of the inner cap and the apertures located in the recess.

4. The makeup powder compact as claimed in claim 1, wherein the stepped protrusion includes bosses extending from a periphery thereof and the cover includes engaging notches defined in an inner periphery thereof, the bosses being engaged with the engaging notches.

5. The makeup powder compact as claimed in claim 1, wherein the receiving space is in a shape of hourglass.

* * * * *